US012426746B1

(12) United States Patent
O'Callaghan et al.

(10) Patent No.: US 12,426,746 B1
(45) Date of Patent: Sep. 30, 2025

(54) PAPER TOWEL HOLDER

(71) Applicant: Dorai Home, Inc., West Valley City, UT (US)

(72) Inventors: Kelsey O'Callaghan, Salt Lake City, UT (US); Jason Klug, Salt Lake City, UT (US)

(73) Assignee: Dorai Home Inc.

( * ) Notice: Subject to any disclaimer, the term of this patent is extended or adjusted under 35 U.S.C. 154(b) by 0 days.

(21) Appl. No.: 19/091,769

(22) Filed: Mar. 26, 2025

Related U.S. Application Data

(60) Provisional application No. 63/570,225, filed on Mar. 26, 2024, provisional application No. 63/663,028, filed on Jun. 21, 2024, provisional application No. 63/730,728, filed on Dec. 11, 2024.

(51) Int. Cl.
*A47K 10/38* (2006.01)

(52) U.S. Cl.
CPC ..... *A47K 10/3836* (2013.01)

(58) Field of Classification Search
USPC ..... 242/597.7, 599.3
See application file for complete search history.

(56) References Cited

U.S. PATENT DOCUMENTS 4,012,007 A 3/1977 Cunningham
4,248,391 A 2/1981 Ness
4,487,376 A * 12/1984 Compton ..... A47K 10/3836 242/612
D283,095 S 3/1986 Compton
4,720,053 A * 1/1988 Vance ..... A47K 10/3836 242/566
5,763,984 A 6/1998 Day
6,793,097 B2 * 9/2004 Kamenstein ..... B65H 16/005 221/33
D563,130 S 3/2008 Griffith et al.
D577,527 S 9/2008 Yu
7,458,541 B1 * 12/2008 Chang ..... A47K 10/3836 248/205.8
7,530,525 B2 * 5/2009 Yang ..... A47K 10/3836 242/597.6
7,604,195 B1 * 10/2009 Lai ..... B65B 59/003 242/396.5
D609,949 S 2/2010 Yang et al.
D717,564 S 11/2014 Goodman et al.
(Continued)

FOREIGN PATENT DOCUMENTS

KR 2023-0001683 * 1/2023

OTHER PUBLICATIONS

KR 20230001683 A, Jan. 5, 2023, "Cup Stand", Ha Sang Deok, English Translation (Year: 2023).*

*Primary Examiner* — William A. Rivera
(74) *Attorney, Agent, or Firm* — Headland Law & Strategy; Matthew J. Smyth

(57) ABSTRACT

A paper towel holder may include a hollow post having a top end and a bottom end; a cap that is secured to the top end with a friction fit; a base assembly comprising a lower base and a top shell; a post base having a post-gripping end and a base-gripping end. The post-gripping end may include ribs that secure the post base to the hollow post at the bottom end and a locking mechanism that secures the post base to the base assembly. The top shell may include diatomaceous earth and may have a flat upper surface and a downward-extending perimeter sidewall.

16 Claims, 5 Drawing Sheets

(56) References Cited

U.S. PATENT DOCUMENTS

| | | | | |
|---|---|---|---|---|
| D771,969 | S | 11/2016 | Hsu | |
| D964,771 | S | 9/2022 | Huang | |
| D964,772 | S | 9/2022 | He | |
| D966,006 | S | 10/2022 | Gao | |
| D982,927 | S | 4/2023 | Gao | |
| D990,913 | S | 7/2023 | Yang | |
| D991,695 | S | 7/2023 | Guo | |
| 2006/0219837 | A1 | 10/2006 | Yang et al. | |
| 2006/0266876 | A1 | 11/2006 | Yang et al. | |
| 2006/0284001 | A1* | 12/2006 | Paradise | A47K 10/3836 242/597.7 |
| 2007/0176043 | A1 | 8/2007 | Yu | |
| 2007/0194168 | A1 | 8/2007 | Yang et al. | |
| 2007/0262191 | A1 | 11/2007 | Amron | |
| 2017/0319019 | A1 | 11/2017 | Simmons | |
| 2019/0374069 | A1* | 12/2019 | Klug | A47K 3/002 |
| 2020/0268220 | A1 | 8/2020 | Hong | |

* cited by examiner

PAPER TOWEL HOLDER

CROSS-REFERENCE TO RELATED APPLICATIONS

This application claims priority to U.S. Provisional Patent Application 63/570,225, titled "Paper Towel Holder," filed Mar. 26, 2024; U.S. Provisional Patent Application 63/663,028, titled "Paper Towel Holder," filed Jun. 21, 2024; and U.S. Provisional Patent Application 63/730,728, titled "Paper Towel Holder," filed Dec. 11, 2024. This application incorporates the entire contents of the foregoing applications by reference.

TECHNICAL FIELD

Various implementations relate generally to paper towel holders.

SUMMARY

A paper towel holder may include a hollow post having a top end and a bottom end; a cap that is secured to the top end with a friction fit; a base assembly comprising a lower base and a top shell; and a post base having a post-gripping end and a base-gripping end. The post-gripping end may include ribs that secure the post base to the hollow post at the bottom end and a locking mechanism that secures the post base to the base assembly. The top shell may include diatomaceous earth and may have a flat upper surface and a downward-extending perimeter sidewall.

In some implementations, the locking mechanism includes a plurality of locking stakes with locking notches and a twist lock having slots and locking extensions that selectively engage with the locking stakes and the locking notches. The lower base and top shell may include apertures to accommodate the locking stakes. The lower base and top shell may further include a centering keyway, and the locking mechanism may further include a centering key that engages with the centering keyway.

The lower base may include a weighted plate that is overmolded with silicone. Feet may be disposed on a bottom surface of the lower base to locate the lower base above a horizontal surface on which the lower base is disposed, with an air gap between the horizontal surface and the bottom surface. The cap may include a wood or simulated wood material, and the hollow post may include aluminum or another metal or simulated metal material.

A paper towel holder may include a post having a top end and a bottom end; a base assembly; and a post base having a post-gripping end and a base-gripping end. The post-gripping end may secure the post base to the post at the bottom end, and a locking mechanism on the base-gripping end may secure to the base assembly. The base assembly may include diatomaceous earth.

The base assembly may include a lower base and a top shell. The top shell may include diatomaceous earth, and the lower base may include a material that is heavier than that the top shell. In some implementations, the lower base includes a metal slab that is overmolded with silicone or another polymer having a Shore A durometer of between about 20 and about 70. The top shell may include a flat upper surface and a downward-extending perimeter sidewall.

The post may be a hollow post and may include a top cap that is secured to the top end with a friction fit. The hollow post and the top cap may be made of materials that are different from each other.

In some implementations, the locking mechanism includes locking threads. In other implementations, the locking mechanism may include a plurality of locking stakes with a locking notches and a twist lock having slots and locking extensions that selectively engage with the locking stakes and the locking notches. The lower base and top shell may include apertures to accommodate the locking stakes. The lower base and top shell may further include a centering keyway, and the locking mechanism may further include a centering key that engages with the centering keyway. The lower base may include a cavity on a bottom surface that is configured to accommodate the twist lock.

DETAILED DESCRIPTION

Figure 1:
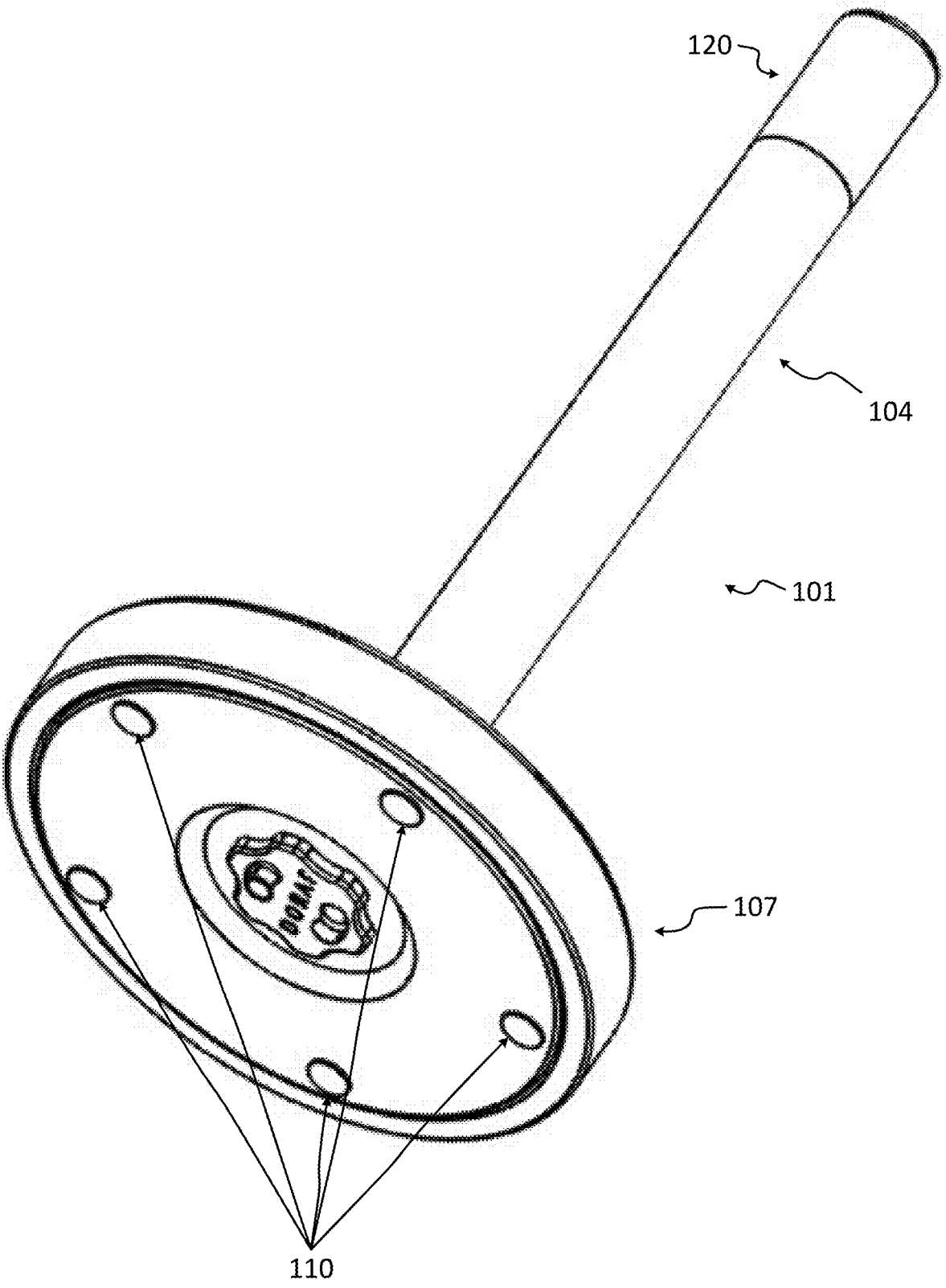
FIG. 1 is a perspective view of an exemplary paper towel holder.

FIG. 1 illustrates an exemplary paper towel holder 101 having a post 104 and a base assembly 107. The post 104 may be a hollow tube and may include a cap 120, which, in some implementations, may be decorative and be made of a different material than the tube 104 (e.g., the tube 104 may be made of aluminum or another metal or simulated metal material, and the cap 120 may be made of a decorative wood, such as beech or oak (or simulated wood material)).

The base assembly 107 may include feet 110 to raise the base assembly 107 slightly above a horizontal surface on which the paper towel holder 101 may be disposed (such that an air gap exists between the horizontal surface and the bottom of the base 107). In some implementations, the feet 110 may enable the paper towel holder 101 to be stably supported by any such surface, even if it is slightly uneven. The base assembly 107 and its feet 110 may include a flexible, resilient and/or soft material, such as, for example, silicone or rubber. In some implementations, the feet 110 may be separate from other portions of the base assembly 107 (e.g., they may be adhesively adhered pads).

Figure 2:
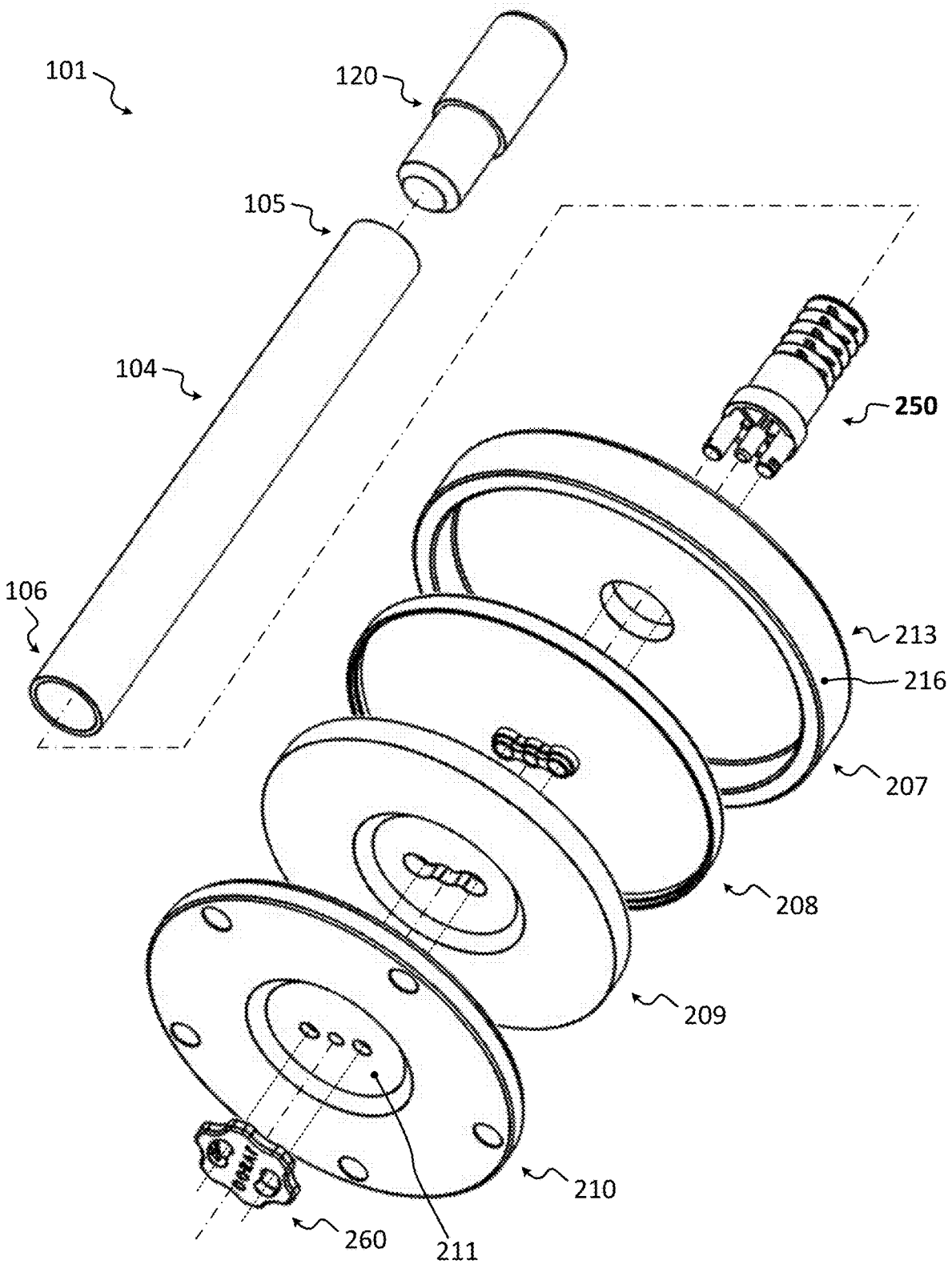
FIG. 2 is an exploded view of the exemplary paper towel holder of FIG. 1.

FIG. 2 is an exploded view of the exemplary paper towel holder 101 showing additional exemplary details. In some implementations, as shown, the cap 120 may be configured to fit into the tube 104 (at a top end 105) and be retained there by an interference or friction fit. A post base 250 may be engaged by a bottom end 106 of the post 104 (e.g., by an interference or friction fit), and the post base 250 may cooperate with a twist lock 260 to retain a diatomaceous earth element 207 and, in some implementations, a base cap 208, a weight 209 and a base bottom 210. In some implementations, the base cap 208 and base bottom 210 may be overmolded (e.g., as a single "skin") onto the weight 209.

The diatomaceous earth element 207 may form a portion of a closed cylinder, in some implementations. That is, as shown, the diatomaceous earth element 207 may include a top surface 213 and a downward-extending perimeter sidewall 216. In some implementations, the diatomaceous earth element 207 is molded (e.g., with a cold press molding or similar process) to facilitate coverage of other elements, such as the base cap 208, the weight 209 and the base bottom 210. Further, the diatomaceous earth element 207 may be configured to absorb water (e.g., water that is dripped onto its surface as paper towels are removed from a paper tower roll that is disposed on the holder 101).

The base cap 208 and base bottom 210 may be made of a polymer, such as ABS (acrylonitrile butadiene styrene), another plastic, a silicone, a hard rubber, or another polymer. In some implementations, as shown, the base cap 208 and the base bottom 210 cooperate to cover the weight 209 (e.g., collectively, in some implementations, a lower base), which may be made of a steel or other metal or material that provides extra mass to anchor the paper towel holder 101. In some implementations, one or more of the base cap 208 and base bottom 210 are omitted; in other implementations, both are omitted and the weight 209 is covered or wrapped (e.g., overmolded) in another material (e.g., a silicone, such as a silicone having a Shore A durometer of between about 20 and about 70) ("about" or "approximately" may mean within 1%, or 5%, or 10%, or 20%, or 50%, or 100% of a nominal value; "substantially" may mean within 1%, or 5%, or 10%, or 20% of a nominal value or position); in still other implementations, the weight 209 is omitted and one or more of the base cap 208 or the base bottom 210 may include additional material to provide mass for anchoring the paper towel holder 101. In some implementations, the non-diatomaceous earth-containing component or assembly is heavier than the diatomaceous earth-containing component. Many variations are possible.

Figure 3A:
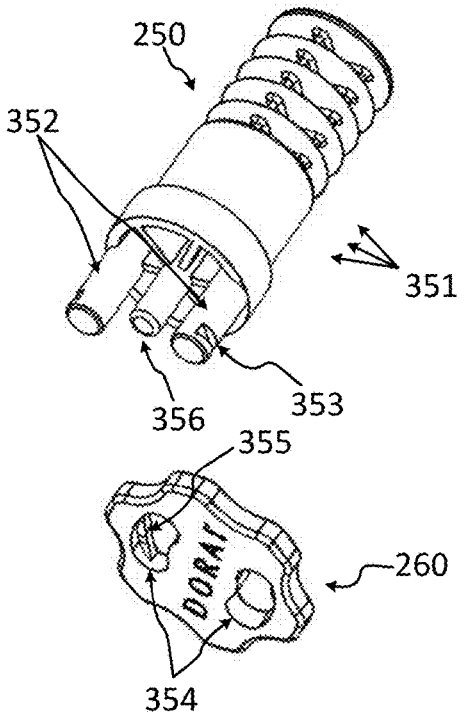
FIGS. 3A-3D illustrate exemplary details of a post base and twist lock.
Figure 3B:
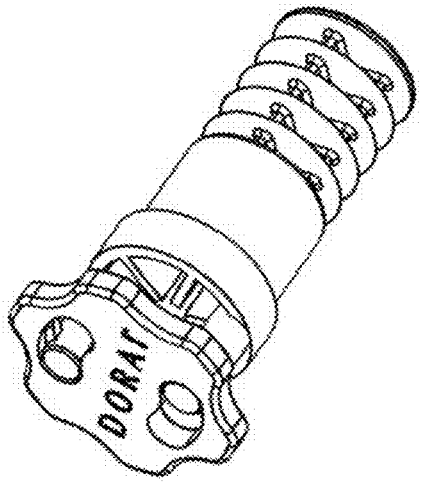
Figure 3C:
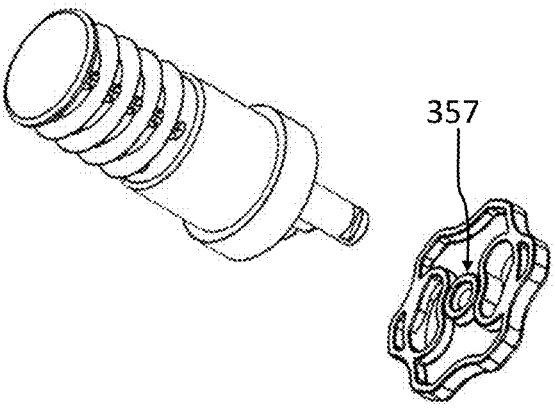
Figure 3D:
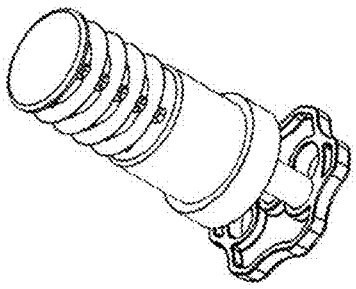

FIGS. 3A-3D illustrate additional details of a locking mechanism-specifically, as shown, the post base 250 and twist lock 260. As shown in FIG. 3A, the post base 250 may include ribs 351 at one end (e.g., a post-gripping end) that are configured to grip the inside of the post 104 to secure the post base 250 to the post 104. At the opposite end (e.g., a base-gripping end), the post base 250 may include two locking stakes 352, which may include notches (e.g., notch 353) that are configured to cooperate with slots 354 and locking extensions (e.g., extension 355) on the twist lock 260. In operation, the slots 354 in the twist lock 260 may be aligned with the locking stakes 352 on the post base 250, and the twist lock 260 may be disposed such that the locking stakes 352 are in the slots 354; then, the twist lock 260 may be rotated, such that the extensions 355 engage with the notches 353, locking the twist lock 260 to the post base 250, as shown in FIGS. 3B and 3D. In some implementations, a centering key 356 may also be provided that is configured to cooperate with a corresponding keyway 357 (see FIG. 3C). In such implementations, the centering key 356 and corresponding keyway 357 may facilitate smooth operation of the twist lock 260, particularly as it is rotated into a locking position.

Figure 4:
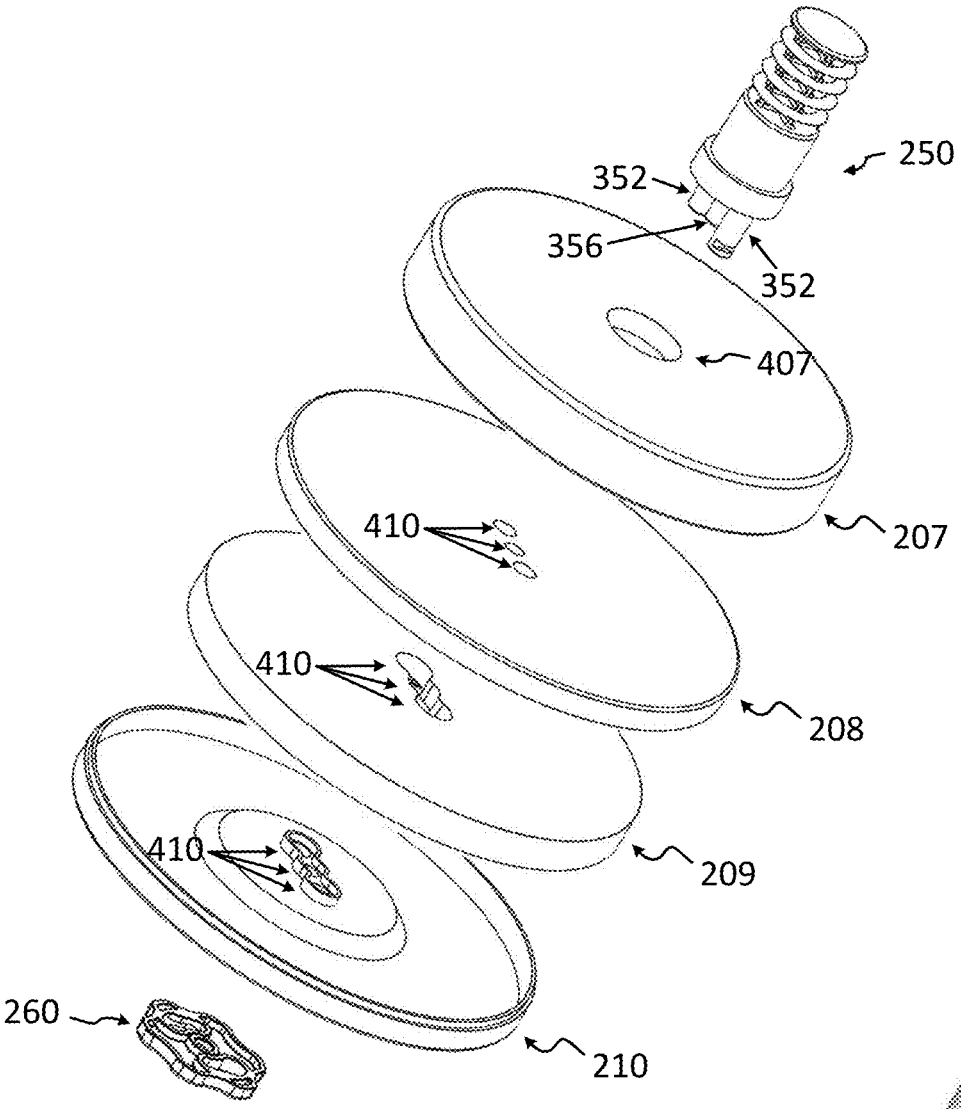
FIG. 4 is an exploded view showing additional detail of the post base, base and twist lock.
Figure 5:
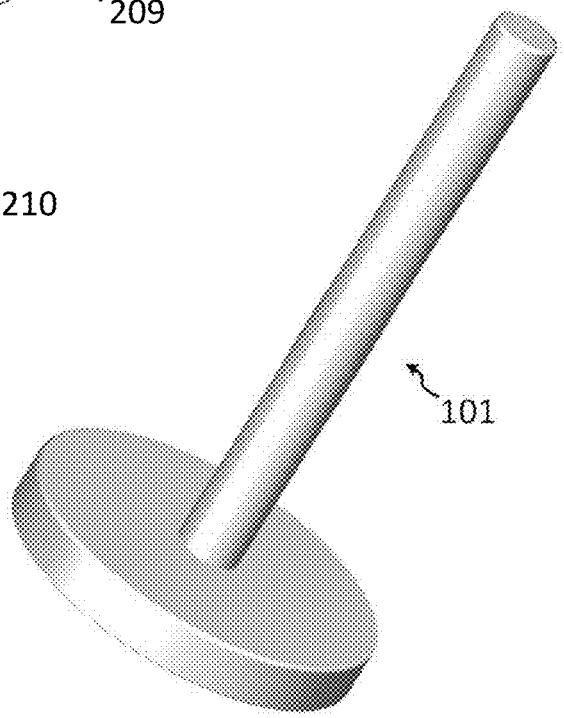
FIG. 5 illustrates an assembled exemplary paper towel holder.

FIG. 4 is an another exploded view depicting how the post base 250 and twist lock 260 can engage and secure together the diatomaceous earth element 207, the base cap 208, the weight 209 and the base bottom 210. In particular, an opening 407 in the diatomaceous earth element 207 may be configured to receive a portion of the post base 250; and the base cap 208, the weight 209 and the base bottom 210 may include apertures 410 that correspond to the locking stakes 352 and optional centering key 356 on the post base 250. The base bottom 210 may include a cavity 211 (see FIG. 2) to receive the twist lock 260. An exemplary assembled holder 101 is shown in FIG. 5.

Figure 6:
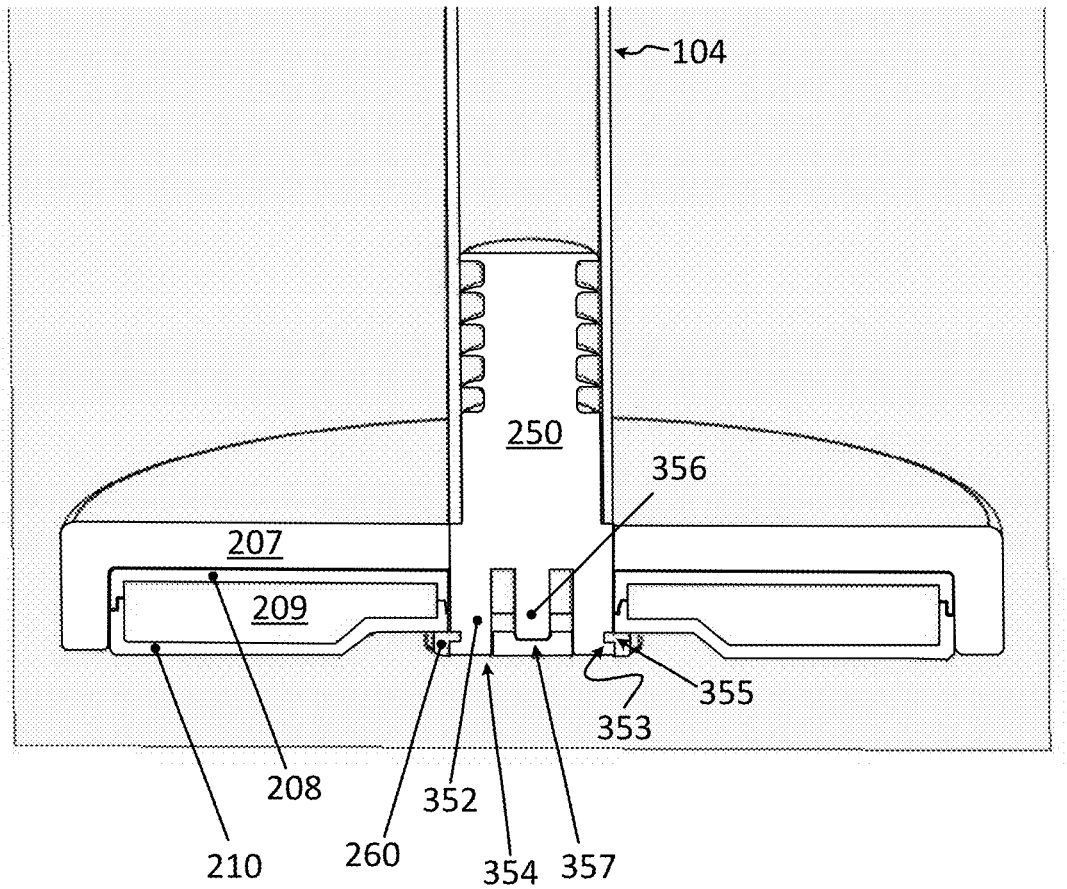
FIG. 6 is a cross-sectional view showing additional details.

FIG. 6 is an exemplary cross section showing additional detail of the various components described above-including the post 104, post base 250, locking stakes 352 with their notches 353, centering key 356, twist lock 260 with its slots 354, etc.

Several implementations have been described with reference to exemplary aspects, but it will be understood by those skilled in the art that various changes may be made and equivalents may be substituted for elements thereof without departing from the contemplated scope. For example, some posts may rotate while others may be fixed; various materials may be employed for various components (e.g., metal, wood, plastics, rubbers, silicones, combinations of the same, etc.); locking mechanisms may include connectors that are threaded, press-fit, or removable, or different components may be adhered with adhesive, co-molded, overmolded, etc.; some implementations include a diatomaceous earth slab, metal disk and silicone base; other implementations may omit one or more of these elements; some implementations omit fins; fasteners other than the threaded fasteners described may be employed (e.g., screws, bolts, pins, press-fit connectors, etc.); elements may be wrapped or overmolded in other materials (e.g., silicone). Other variations are possible.

What is claimed is:

1. A paper towel holder, comprising:

a hollow post having a top end and a bottom end;

a cap that is secured to the top end with a friction fit;

a base assembly comprising a lower base and a top shell; and a post base having a post-gripping end and a base-gripping end, wherein the post-gripping end comprises ribs that secure the post base to the hollow post at the bottom end and a locking mechanism that secures the post base to the base assembly; and wherein the top shell comprises diatomaceous earth and has a flat upper surface and a downward-extending perimeter sidewall.

2. The paper towel holder of claim 1, wherein the locking mechanism comprises a plurality of locking stakes with locking notches; and a twist lock having slots and locking extensions that selectively engage with the locking stakes and the locking notches.

3. The paper towel holder of claim 2, wherein the lower base and the top shell comprise apertures to accommodate the locking stakes.

4. The paper towel holder of claim 3, wherein the lower base and top shell further comprise a centering keyway and the locking mechanism further comprises a centering key that engages with the centering keyway.

5. The paper towel holder of claim 1, wherein the lower base comprises a weighted plate that is overmolded with silicone.

6. The paper towel holder of claim 5, further comprising feet disposed on a bottom surface of the lower base to locate the lower base above a horizontal surface on which the lower base is disposed, with an air gap between the horizontal surface and the bottom surface.

7. The paper towel holder of claim 1, wherein the cap comprises a wood or simulated wood material, and wherein the hollow post comprises aluminum or another metal or simulated metal material.

8. A paper towel holder, comprising:

a post having a top end and a bottom end;

a base assembly; and a post base having a post-gripping end and a base-gripping end, wherein the post-gripping end secures the post base to the post at the bottom end, and a locking mechanism on the base-gripping end secures to the base assembly, wherein the locking mechanism comprises a plurality of locking stakes with locking notches and a twist lock having slots and locking extensions that selectively engage with the locking stakes and the locking notches;

wherein the base assembly comprises diatomaceous earth.

9. The paper towel holder of claim 8, wherein the base assembly comprises a lower base and a top shell, wherein the top shell comprises diatomaceous earth and the lower base comprises a material that is heavier than that the top shell.

10. The paper towel holder of claim 9, wherein the lower base comprises a metal slab that is overmolded with silicone or another polymer having a Shore A durometer of between about 20 and about 70.

11. The paper towel holder of claim 9, wherein the top shell comprises a flat upper surface and a downward-extending perimeter sidewall.

12. The paper towel holder of claim 8, wherein the post is a hollow post and includes a top cap that is secured to the top end with a friction fit, wherein the hollow post and the top cap comprise materials that are different from each other.

13. The paper towel holder of claim 8, wherein the locking mechanism comprises locking threads.

14. The paper towel holder of claim 8, wherein the lower base and top shell comprise apertures to accommodate the locking stakes.

15. The paper towel holder of claim 8, wherein the lower base and top shell further comprise a centering keyway and the locking mechanism further comprises a centering key that engages with the centering keyway.

16. The paper towel holder of claim 8, wherein the lower base comprises a cavity on a bottom surface that is configured to accommodate the twist lock.

* * * * *